United States Patent [19]

Wells et al.

[11] 4,426,855

[45] Jan. 24, 1984

[54] YARN FEEDER MECHANISMS

[75] Inventors: Anthony J. Wells, Cosby; William C. Smith, Leicester; Gerald A. G. Seekings, Birstall, all of England

[73] Assignee: The Bentley Engineering Co., Ltd., Leicester, England

[21] Appl. No.: 293,443

[22] Filed: Aug. 14, 1981

[30] Foreign Application Priority Data

Aug. 19, 1980 [GB] United Kingdom ..... 8026987

[51] Int. Cl.[3] ..... D04B 15/08; D04B 15/58

[52] U.S. Cl. ..... 66/125 R; 66/111; 66/138

[58] Field of Search ..... 66/111, 125 R, 131, 66/133, 138, 139, 140 R

[56] References Cited

U.S. PATENT DOCUMENTS

| | | | |
|---|---|---|---|
| 1,340,695 | 5/1920 | Ames | 66/111 X |
| 1,945,227 | 1/1934 | Montagne et al. | 66/138 X |
| 2,117,115 | 5/1938 | Miller | 66/138 |
| 2,409,306 | 10/1946 | Page et al. | 66/111 X |
| 3,048,990 | 8/1962 | Moyer | 66/138 |
| 3,201,957 | 8/1965 | Levin | 66/138 |
| 3,397,556 | 8/1968 | Wood | 66/111 |
| 3,555,855 | 1/1971 | Billi | 66/138 |
| 4,120,179 | 10/1978 | Micheletti | 66/140 R X |

FOREIGN PATENT DOCUMENTS

| | | | |
|---|---|---|---|
| 280516 | 11/1914 | Fed. Rep. of Germany | 66/111 |
| 2237712 | 7/1973 | Fed. Rep. of Germany | 66/125 R |

*Primary Examiner*—Wm. Carter Reynolds

[57] ABSTRACT

A yarn feeder mechanism for circular knitting machines has a plurality of feed fingers with yarn feed extremities at the front thereof and movable between a low feed position and a high inactive position, means for selectively lowering the feed fingers, and a latchguard plate which is liftable to a non-obstructing position. The feed fingers are associated with abutment means for engaging the feed fingers to the rear of the respective yarn feed extremities and means are provided for simultaneously lifting the yarn feed extremities and the latchguard plate to the non-obstructing inactive position while maintaining the latchguard plate in spaced relationship to the yarn feed extremities in the non-obstructing position.

7 Claims, 6 Drawing Figures

YARN FEEDER MECHANISMS

DESCRIPTION

1. Field of Invention

The invention relates to yarn feeder mechanisms for use in circular knitting machines and in particular seamless knitting machines.

2. Background of the Invention

Yarn feeder mechanisms have a plurality of fingers which can be selectively lowered to effect knitting. The mechanisms may have latchguards or throatplates associated therewith.

U.S. Pat. No. 3,555,855 discloses a mechanism which permits lifting of all feed fingers, both selected and unselected, at the same time by pivoting the feed finger mounting. More recent machines utilise the lifting of a latchguard plate to lift any lowered fingers to a high level which is common to all feeders.

The mountings and latchguards are pivoted by tappets, the tappets being pushed up vertically by cams on a ring concentric with a needle cylinder of the machine. It is the object of the invention to provide a yarn feeder mechanism capable of changing feeders reliably.

SUMMARY OF INVENTION

The invention provides a yarn feeder mechanism for a circular knitting machine having a plurality of yarn feed fingers with yarn feed extremities at the front thereof, the fingers being, movable between a low feed position and a high inactive position. The mechanism of the invention includes a latchguard plate, movable between a low latchguarding position and a high inactive position clear of a needle cylinder, and adjustable abutment means for engaging the yarn feed fingers to the rear of the respective yarn feed extremities. The invention further includes means for simultaneously lifting the yarn feed extremities and latchguard plate so as to enable the yarn feed fingers to be adjustably spaced from the plate in the active position and the resulting spacing to be maintained when lifting the yarn feed extremities and latchguard plate. The yarn feed extremities of the fingers may be delicate, particularly if the yarn feed extremities are formed by friction resistant hollow tubes located in a longitudinally aligned slot in a body of the yarn feed fingers, and are prevented from contacting the latchguard plate. At the same time the tubes can be positioned optimally to create desirable yarn feed conditions when introducing a yarn. The travel of the yarn feed extremities can, in accordance with the invention be kept small thereby reducing the amount of any slack yarn.

To facilitate vertical adjustment of the yarn feed extremities, the feed fingers are pivotable and the abutment means includes a plurality of adjustable screws, one for each finger and the rear ends of the respective fingers are urged upwardly by springs.

Preferably the simultaneous lifting means is a pivotable member for engaging the front ends of the respective fingers from below and projecting sideways under an arm for lifting the latchguard plate. Thus a simple member can lift both feed fingers and latchguard plate with the requisite delay. Advantageously an adjustment stud is provided for controlling the timing of engagement of the pivotable member and the latchguard arm during the pivoting of the member to thereby control the lag between the feed fingers and the latchguard plate on operation of the pivotable lifting means member.

In a circular knitting machine using a plurality of yarn feed mechanisms, preferably the mechanisms are each provided with a pivotable member having a projecting rear end and a pivot lever for depressing the rear end, the pivot brackets having depending lever arms. A ring passes under the yarn feed mechanisms and has studs for engaging the lever arms and lifting feed fingers and latchguard plates at all the yarn feed mechanisms simultaneously but with a lag between the feed fingers and the latchguard plates. The ring is known from prior art but the engagement between the ring and the lever arms is an abutting one and does not involve a cam action. As a consequence the force of the return springs on the feed fingers and latchguard plates tends to bias the ring away from the deactivating position. Jamming on cams is avoided and the feeder mechanisms return smoothly to their active positions when required. In order to counter this when the operator so requires, preferably a means is provided for locking the ring in the position in which the feed fingers and latchguard plates are lifted. The operator thus can select unambiguously whether he requires a locked condition or an automatic return condition.

These measures can help to improve feeding not only by permitting an optimal location both vertically and radially of the opening from which yarn is fed to the needles. At the same time a more vigorous return motion of the feed fingers can be created by stronger springs, if necessary. These springs will not cause breaking of protruding friction resistant hollow tubes on the feed finger extremity since any shocks are absorbed by the abutment means.

Advantageously means are provided for de-activating a latch opener when the ring is turned and the latch opener has a manual override.

The invention also provides a circular knitting machine having a plurality of yarn feeder mechanisms each with a plurality of yarn feed fingers with yarn feed extremities at the front thereof movable between a low feed position and a high inactive position, a latchguard plate movable between a low latchguarding position and a high inactive position clear of a needle cylinder in which the mechanisms are each provided with a pivotable member having a projecting rear end and a front end adapted to lift the feed fingers and latchguard plate, and a pivot lever for depressing the rear end, the pivot levers having depending lever arms and in which a ring passes under the yarn feeder mechanisms with studs for engaging the lever arms and lifting feed fingers and latchguard plates at all the yarn feeder mechanisms simultaneously. The pivot levers, preferably bell crank levers, have a very light action and can be used to lift yarn feed fingers which are not adjustably spaced from the latchguard plate and which are raised by the lifting of the latchguard plate.

DRAWINGS

SPECIFIC DESCRIPTION

Construction

Figure 1:
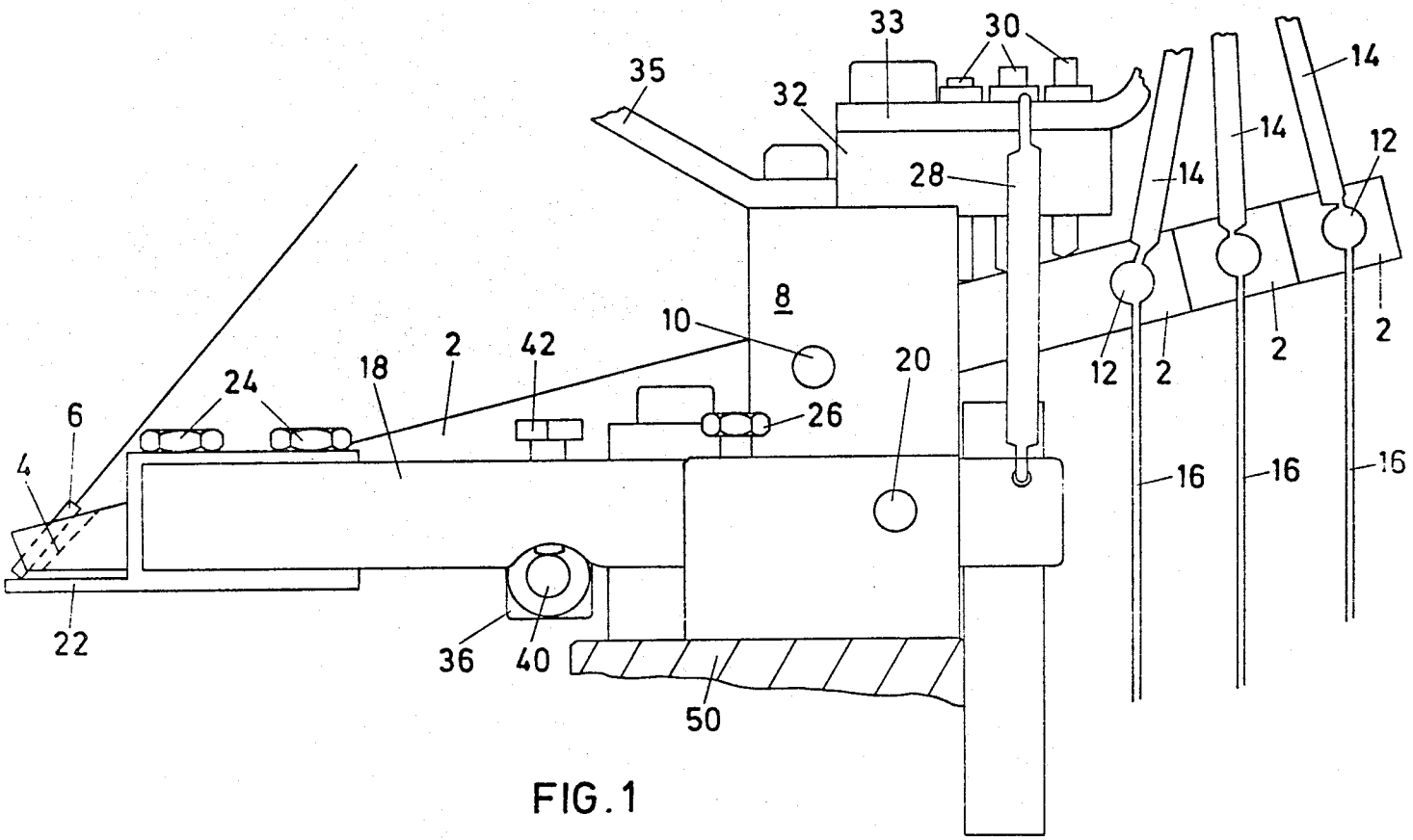
FIG. 1 is a side view of a yarn feeder mechanism according to the invention.

With reference to FIGS. 1 to 5, a yarn feeder mechanism has five yarn feed fingers 2 with longitudinally aligned front end slots 4 which receive friction-resistant yarn guide tubes 6. Tubes 6 may be adhesively secured in slots 4 and form the yarn feed extremities of the respective fingers. The fingers 2 are pivotably mounted on a body 8 by a shaft 10. The fingers 2 have posts 12 to the rear of the shaft 10. Return springs 14 and the wires 16 of Bowden cables, connected to a yarn feed finger selection mechanism, are connected to posts 12. The rear ends of the fingers 2 have different lengths so that the posts are at different distances from the shaft 10 whereby the fingers 2 can be packed closely together. For the sake of convenience the fingers 2 are regarded as being "lowered" or "lifted" when the yarn feed extremities are lowered or lifted.

A latchguard plate mounting arm 18 pivots about a shaft 20 in the body 8 and carries a latchguard plate 22 secured by a pair of screws 24 in a slot to permit adjustment of the latchguard plate 22 in a horizontal plane. The arm 18 carries a stud 26 for abutting the body 8 and permitting a heightwise adjustment of the plate 22. A return spring 28 urges the stud 26 towards the body 8.

Five adjusting screws 30 are screwed into a block 32 bolted to the body 8. The screws engage the rear ends of respective of the feed fingers 2. The block 32 also carries an anchor plate 33 for the top ends of the springs 14 and spring 28. A plate 35, having yarn guide eyes 34 (FIG. 2) located over the front ends of the fingers 2, is also bolted to the top of the body 8.

Figure 2:
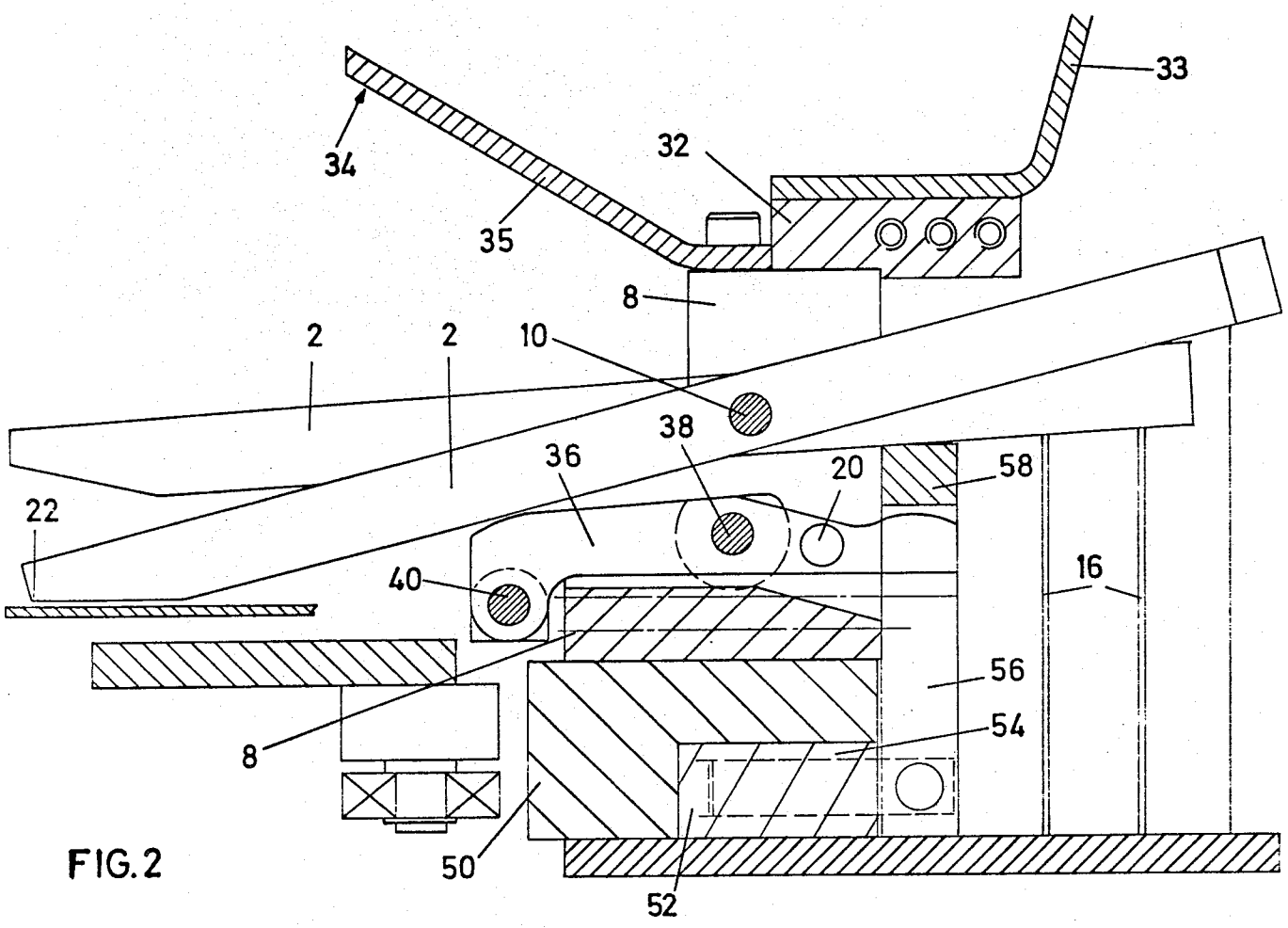
FIG. 2 is a side view of a section of the yarn feeder mechanism of FIG. 1 with the mechanism in an operative condition.
Figure 3:
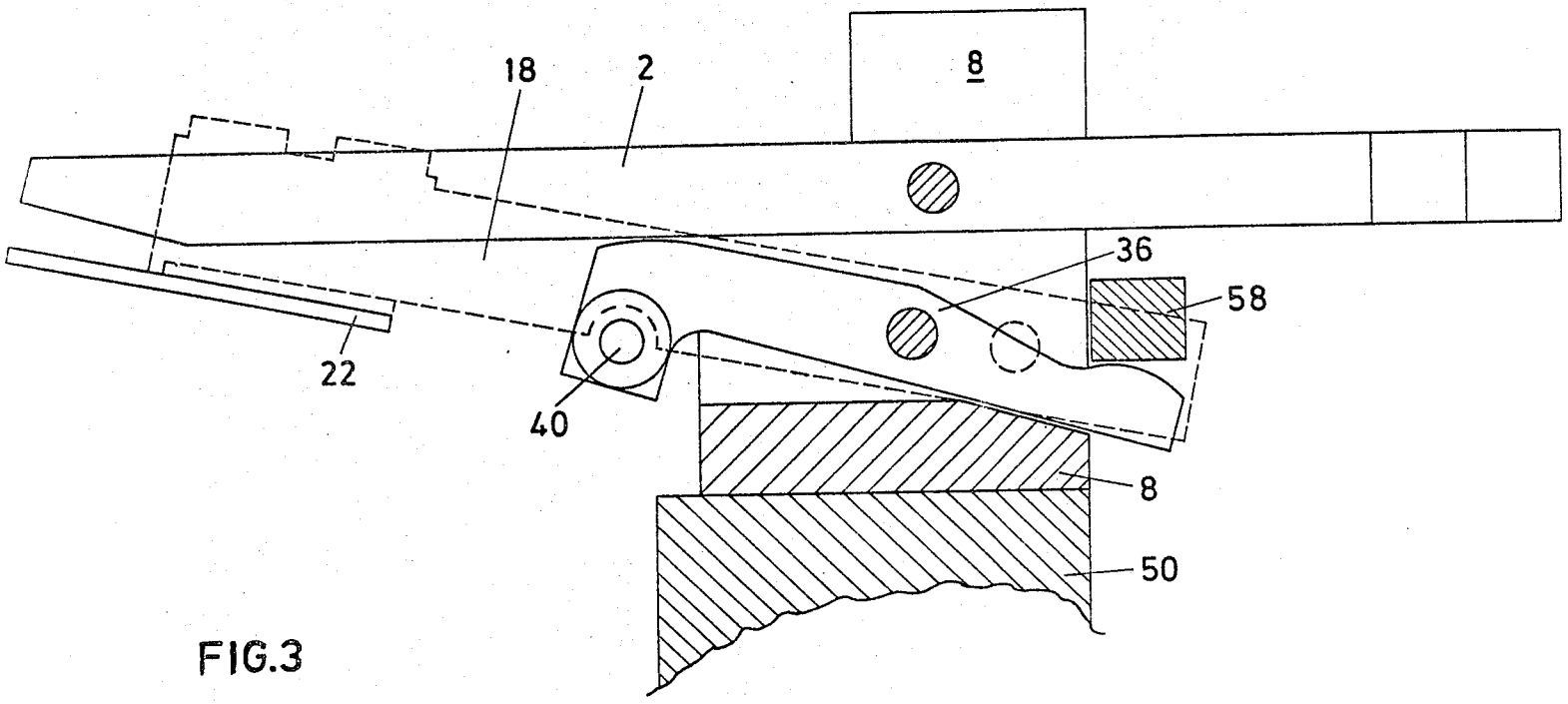
FIG. 3 is a side view of a section of the yarn feeder mechanism of FIG. 1 but with the mechanism in a deactivated condition.
Figure 4:
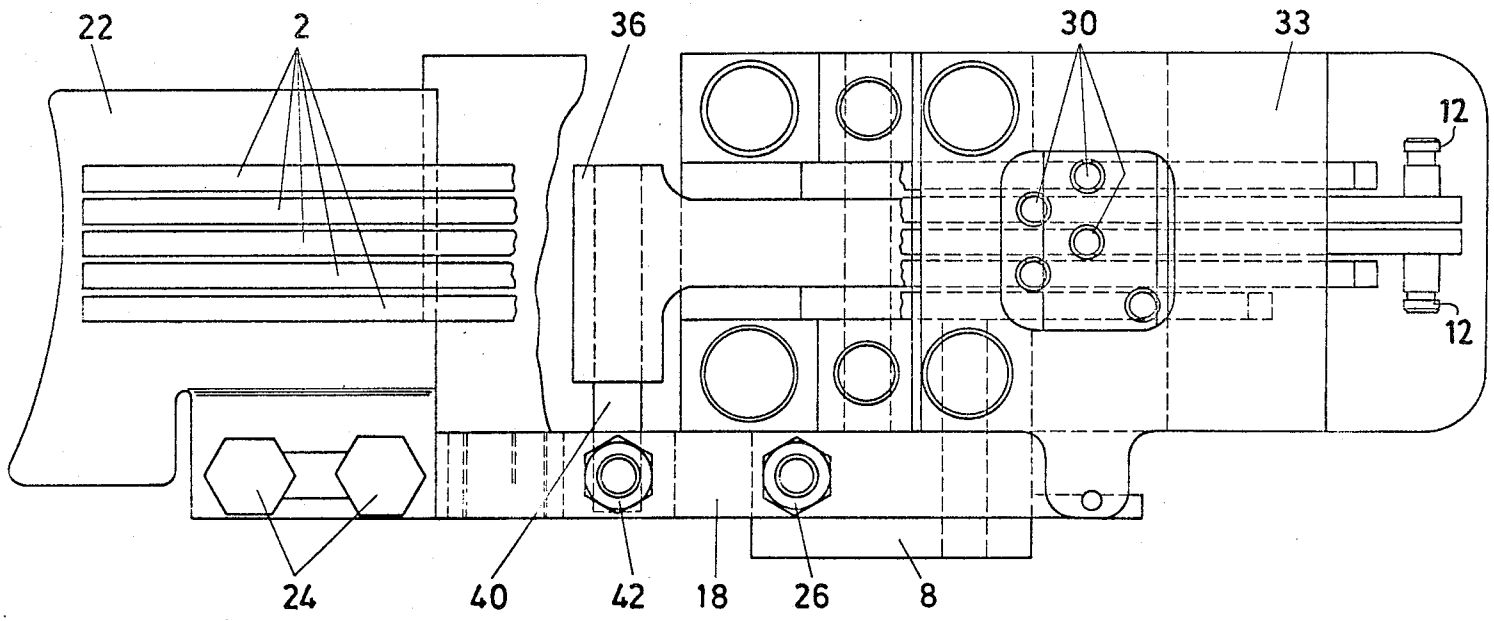
FIG. 4 is a partly broken away top view of the yarn feeder mechanism of FIG. 1.

A pivotable member 36, which may be seen from FIGS. 2 and 3, is pivotably mounted on a shaft 38 inside the body 8 and is located below the yarn feed fingers 2. The front end of the member 36 can bear against the front ends of the fingers 2. The member 36 has a pin 40 extending sideways therefrom to a point lying underneath the arm 18. The arm 18 has a further stud 42 adjustably spacing the arm 18 from the pin 40.

In a typical machine four such yarn feed mechanisms (see FIG. 6) will be mounted on a support ring 50 which is fixed. The ring 50 has a cut away into which a rotatable control ring 52 (FIG. 5) is set. The ring 52 carries four studs 54 for abutting adjustment screws 55 in depending arms 56 of bell crank levers 58 pivotably mounted by shafts 60 in the bodies 8. The ring 50 also carries a latch opener 62 by means of a pivot mounting 63. The mounting 63 carries a spring (not shown) urging the latch opener to its active position. There is also a slide 65 having a pin 67 which, under the tension of another spring, urges the latch opener to the inactive position. The slide spring normally overcomes the bias of the mounting spring. The latch opener can thus be placed in an active position by hand through the use of a lever 64 which returns the slide 65 upwards in FIG. 6 and allows the mounting 63 to pivot to the active position. The latch opener can also be placed in an active condition; under control of the control drum by a cable anchored at 66 which pulls the slide 65 upwards. When the ring 52 is rotated a stud 58 pushes against the rear end of the latch opener and pivots it to the inactive position. The ring 52 can be locked in position by a pin 70 which passes through the ring 50 to engage in a hole in the ring 52.

Use

The active position of the feeders is when the feed fingers 2 are lowered with the lower end of the tubes 6 close to the plate 22 (see FIG. 1). The distance of the extremities to the plate 22 can be set by adjusting the screws 30. During normal knitting, one feed finger 2 is lowered and the remainder are raised (see FIG. 2) so that the yarns are not picked up by needles in the cylinder (not shown). In the course of knitting the selection will be varied by pulling and releasing the wires 16 to lower and raise the appropriate fingers 2.

Figure 5:
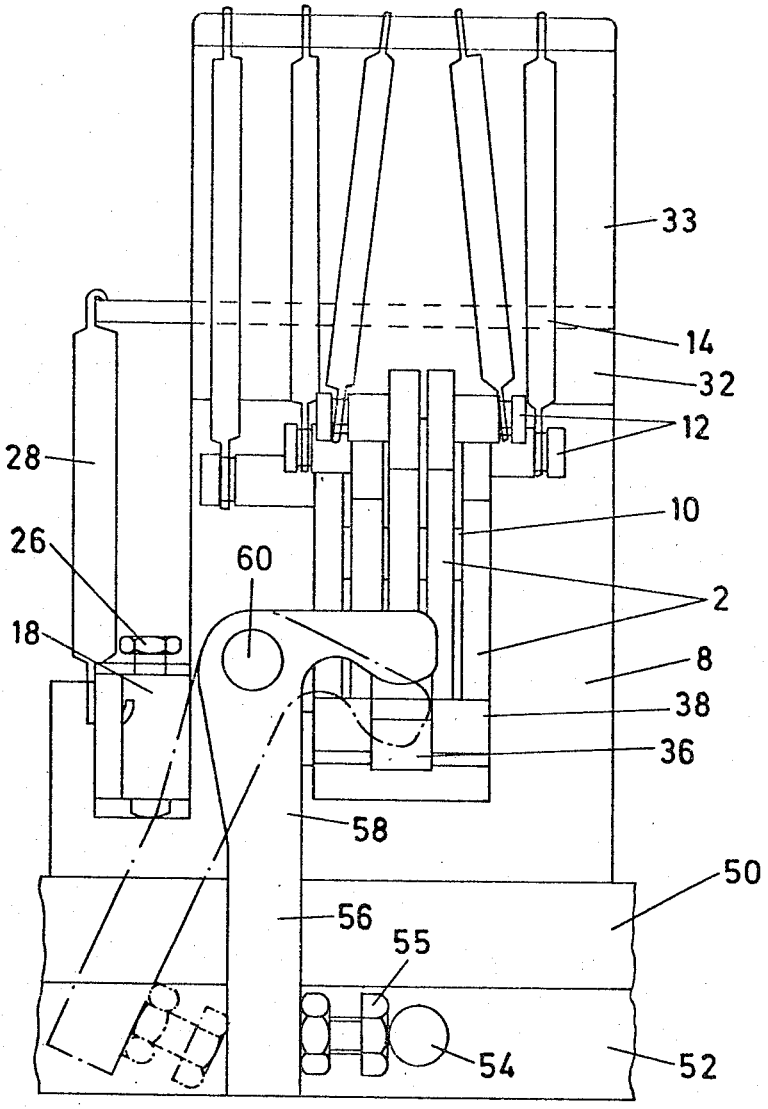
FIG. 5 is a rear view of the yarn feeder mechanism of FIG. 1.
Figure 6:
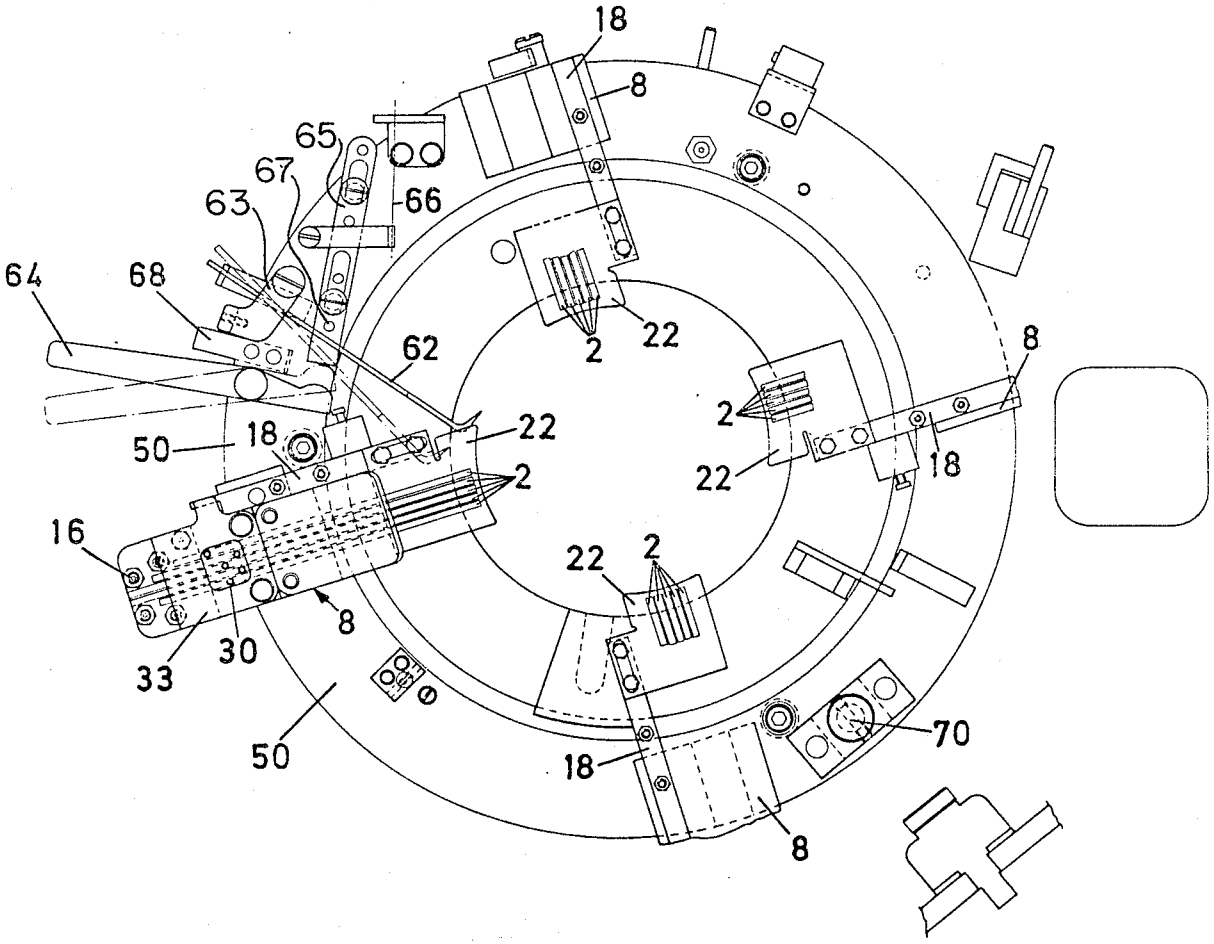
FIG. 6 is a plan view of a top of a cylinder of a seamless knitting machine showing the surrounding yarn feed mechanisms and associated components.

When there is a mal-function and an operator has to gain access to the cylinder, the ring 52 is rotated to pivot the lever 58 from the position shown in solid lines in FIG. 5 to the chain-dot position. As a result the member 36 pivots from the position shown in FIG. 2 to that in FIG. 3. First, the yarn feed fingers 2 are initially raised and then, after a lag determined by the setting of the stud 42, the plate 22 is lifted together with the lifting of the fingers 2. Thus the yarn feed extremities are lifted ahead of the plate 22, regardless of the adjustment of the screws 30. Those feed fingers 2 which are already inactive, are barely affected by the operation.

The ring 52 can be locked in position so that the operator can attend to any problems without needing to hold ring 52. On lifting of the pin 70, the force of the springs 14 and 28 causes the selected feed fingers 2 and the plate 22 to be lowered simultaneously. After the lowered feed finger 2 abuts its screw 30, the plate 22 continues its movement for a brief period until the screw 26 abuts the body 8.

All operative positions, motions and arcs of movement can be adjusted. At the same time strong springs can be used to give a vigorous lowering action. The guide tubes 6 can thus be set to provide a reliable yarn insertion. The yarn feed mechanism can be used with ease in conjunction with the latch opener control arrangements by an operative.

We claim:

1. A yarn feeder mechanism for a circular knitting machine comprising:

a plurality of yarn feed fingers, a yarn feed extremity being located at the front end of each of said fingers;

means for selectively actuating said fingers to cause each yarn feed extremity to move between a flow feed position and a high inactive position;

a latchguard plate;

a mounting supporting said latchguard plate, said mounting being pivotable to move said plate between a low, latchguarding position and a high, inactive position wherein the latchguard is clear of a needle cylinder;

adjustable abutment means for each of said yarn feed fingers, said abutment means engaging the yarn feed fingers at a point displaced from the yarn feed extremities thereof, said abutment means limiting downward movement of the extremities and adjustably spacing the extremities from the latchguard plate in the low position; and means for lifting said yarn feed fingers and said latchguard plate, said lifting means including a pivotable member having a front face part for engaging the yarn feed fingers from below during an initial phase of the lifting movement, said lifting means member further having a sideways extension for engaging said latchguard plate mounting from below during a later phase of the movement thereof to thereby simultaneously lift the yarn feed fingers and the latchguard plate while preserving a spacing between said plate and the yarn feed extremities.

2. A yarn feeder mechanism as claimed in claim 1 in which the yarn feed extremities comprise friction resistant hollow tubes, the yarn feed fingers each include a pivotable body with a slot for receiving an associated one of said tubes, the abutment means comprises a plurality of adjustable screws, one of said screws being associated with each of said feed fingers, and wherein said mechanism further comprises means for resiliently biasing individual associated yarn feed finger bodies into engagement with an associated adjustable screw so as to lower the feed finger tube into close proximity to the latchguard plate when desired.

3. The yarn feeder mechanism of claim 1 wherein the latchguard plate mounting carries an adjustment screw for engaging the sideways extension of said lifting means member to thereby control the spacing between the latchguard plate and the yarn feed extremities during operation of the lifting means pivotable member.

4. Circular knitting machine having a plurality of yarn feeder mechanisms each including a plurality of yarn feed fingers, yarn feed extremities at a front end of each of the fingers, means for selectively moving each yarn feed extremity between a low, feed position and a high inactive position;

a latchguard plate, a mounting supporting the latchguard plate and pivotable for movement between a low, latchguarding position and a high, inactive position with the latchguard clear of a needle cylinder;

adjustable abutment means one for each yarn feed finger, for engaging the yarn feed fingers to the rear of the yarn feed extremities to thereby limit downward movement of the extremities and space them adjustably from the latchguard plate in the low position;

means for lifting the yarn feed extremities jointly and also the latchguard plate, said means having a part for engaging the yarn feed fingers during an initial part of the lifting movement and a further part for engaging the latchguard plate mounting during a later part of the movement to thereby lift the yarn feed extremities and the latchguard plate whilst preserving a spacing therebetween, said joint lifting means having a rearward projecting end, and there being associated with each such rearward projecting end a pivot lever for depressing the rear end having a depending lever arm, said knitting machine further including a ring passing under all said yarn feeder mechanisms having studs for engaging all the depending lever arms on rotation of said ring to thereby lift all yarn feed extremities and latchguard plates at the same time.

5. Circular knitting machine according to claim 4 having a means for locking the ring in the position where the studs are operative to lift the yarn feed extremities and the latchguard plates.

6. Circular knitting machine according to claim 4 having a latch opener and the ring carries means for de-activating the latch opener when the studs are operative.

7. Circular knitting machine according to claim 5 in which manually operable means are provided for de-activating the latch opener when the studs are inoperative.

* * * * *